US011341905B2

(12) United States Patent
Liu et al.

(10) Patent No.: US 11,341,905 B2
(45) Date of Patent: May 24, 2022

(54) LEVEL CONVERTER, DATA PROCESSING METHOD, AND DISPLAY DEVICE

(71) Applicants: BOE MLED TECHNOLOGY CO., LTD., Beijing (CN); BOE TECHNOLOGY GROUP CO., LTD., Beijing (CN)

(72) Inventors: Hong Liu, Beijing (CN); Yankai Gao, Beijing (CN); Guofeng Hu, Beijing (CN); Yuxin Bi, Beijing (CN); Mingjian Yu, Beijing (CN); Lingyun Shi, Beijing (CN); Ming Chen, Beijing (CN)

(73) Assignees: BOE MLED Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/270,475

(22) PCT Filed: May 25, 2020

(86) PCT No.: PCT/CN2020/092122
§ 371 (c)(1),
(2) Date: Feb. 23, 2021

(87) PCT Pub. No.: WO2020/238855
PCT Pub. Date: Dec. 3, 2020

(65) Prior Publication Data

US 2021/0256902 A1 Aug. 19, 2021

(30) Foreign Application Priority Data

May 27, 2019 (CN) ..... 201910446823.X

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01)

(58) Field of Classification Search
CPC ..... G09G 3/32
(Continued)

(56) References Cited

U.S. PATENT DOCUMENTS 6,747,617 B1 6/2004 Kawashima
9,224,327 B2 12/2015 Hyeon et al.
(Continued)

FOREIGN PATENT DOCUMENTS

CN 101276562 A 10/2008
CN 103187027 A 7/2013
(Continued)

*Primary Examiner* — Long D Pham
(74) *Attorney, Agent, or Firm* — Chiwin Law LLC

(57) ABSTRACT

A level converter, a data processing method, and a display device are provided. The level converter is used for providing a direct current signal for image display and includes a storage circuit, a processing circuit, and a level conversion component. The level conversion component includes a plurality of level conversion circuits; the storage circuit is configured to store image data of an image to be displayed; the processing circuit is in signal connection with the storage circuit, and is configured to obtain control data corresponding to the image data of the image to be displayed according to the image data; and the level conversion component is in signal connection with the processing circuit, and is configured to control whether each of the plurality of level conversion circuits performs level conversion according to the control data, so as to generate the direct current signal.

19 Claims, 4 Drawing Sheets

(58) Field of Classification Search
USPC ..... 345/690
See application file for complete search history.

(56) References Cited

U.S. PATENT DOCUMENTS

| | | | | |
|---|---|---|---|---|
| 10,447,252 | B2 | 10/2019 | Hwang | |
| 2001/0022520 | A1* | 9/2001 | Matsumoto | H03K 19/0027 326/81 |
| 2008/0238906 | A1* | 10/2008 | Kwon | G09G 3/3688 345/208 |
| 2012/0223980 | A1 | 9/2012 | Hollevoet et al. | |
| 2014/0240208 | A1* | 8/2014 | Kim | H03K 3/35613 345/87 |
| 2017/0309217 | A1 | 10/2017 | Kim et al. | |

FOREIGN PATENT DOCUMENTS

| | | | |
|---|---|---|---|
| CN | 207835431 | U | 9/2018 |
| CN | 109979410 | A | 7/2019 |
| CN | 110136641 | A | 8/2019 |
| JP | 2001143867 | A | 5/2001 |
| WO | 2011061688 | A3 | 4/2012 |

* cited by examiner

LEVEL CONVERTER, DATA PROCESSING METHOD, AND DISPLAY DEVICE

This application is a U.S. National Phase Entry of International Application No. PCT/CN2020/092122 filed on May 25, 2020, designating the United States of America and claiming priority to Chinese Patent Application No. 201910446823.X, filed on May 27, 2019. The present application claims priority to and the benefit of the above-identified applications and the above-identified applications are incorporated by reference herein in their entirety.

TECHNICAL FIELD

Embodiments of the present disclosure relate to a level converter, a data processing method, and a display device.

BACKGROUND

As new generation of mainstream display technology, a micro light-emitting diode (micro LED) may be widely used in the fields of optoelectronics, microelectronics, electronic information science, optics, and the like due to high luminous efficiency, small size, low power consumption, long service life, etc. The micro LED is another display technology with advantages of light weight, thin thickness, power saving, and the like since the organic light-emitting diode (OLED).

SUMMARY

At least one embodiment of the present disclosure provides a level converter, and the level converter is used for providing a direct current signal for image display and comprises a storage circuit, a processing circuit, and a level conversion component; the level conversion component comprises a plurality of level conversion circuits; the storage circuit is configured to store image data of an image to be displayed; the processing circuit is in signal connection with the storage circuit, and is configured to obtain control data corresponding to the image data of the image to be displayed according to the image data; and the level conversion component is in signal connection with the processing circuit, and is configured to control whether each of the plurality of level conversion circuits performs level conversion according to the control data, so as to generate the direct current signal.

For example, in the level converter provided by an embodiment of the present disclosure, the processing circuit is configured to obtain a magnitude of a current required to display the image data of the image to be displayed according to the image data, and obtain the control data corresponding to the current according to a preset correspondence between a display current and control data.

For example, in the level converter provided by an embodiment of the present disclosure, the level conversion component further comprises a distribution circuit and a plurality of control circuits, and each of the plurality of control circuits corresponds to at least one level conversion circuit; the distribution circuit is connected to the processing circuit and the plurality of control circuits, respectively, and is configured to respectively provide a plurality of data units, in one-to-one correspondence with the plurality of control circuits, to the plurality of control circuits based on the control data, so as to control working states of the plurality of control circuits, respectively; and the each of the plurality of control circuits is connected to at least one corresponding level conversion circuit and is configured to control whether the corresponding level conversion circuit performs level conversion according to a corresponding data unit.

For example, in the level converter provided by an embodiment of the present disclosure, the distribution circuit is configured to divide the control data into the plurality of data units and distribute each of the plurality of data units to a corresponding control circuit.

For example, in the level converter provided by an embodiment of the present disclosure, the plurality of control circuits are in one-to-one correspondence with the plurality of level conversion circuits.

For example, in the level converter provided by an embodiment of the present disclosure, the each of the plurality of control circuits comprises a control logic circuit and a switch circuit, the control logic circuit is connected to the distribution circuit and the switch circuit, the level conversion circuit is connected to the switch circuit, and the control logic circuit is configured to control the switch circuit to be turned on or turned off according to the corresponding data unit, so as to control whether the level conversion circuit connected to the switch circuit performs level conversion.

For example, in the level converter provided by an embodiment of the present disclosure, each of the plurality of data units comprises first data or second data, the first data being different from the second data; and the control logic circuit is configured to control the switch circuit to be turned on to allow the level conversion circuit to perform level conversion in a case where the corresponding data unit is the first data, and the control logic circuit is configured to control the switch circuit to be turned off to allow the level conversion circuit to be unable to perform level conversion in a case where the corresponding data unit is the second data.

For example, in the level converter provided by an embodiment of the present disclosure, a size of data buffered in a memory space of the storage circuit is greater than a size of data for one image frame.

For example, in the level converter provided by an embodiment of the present disclosure, the storage circuit comprises a random access memory, the processing circuit comprises a field programmable gate array, and the distribution circuit comprises a data distributor.

For example, in the level converter provided by an embodiment of the present disclosure, the each of the plurality of level conversion circuits comprises a boost circuit and/or a buck circuit.

For example, in the level converter provided by an embodiment of the present disclosure, the level converter is used for providing the direct current signal to a display panel, so as to enable the display panel to generate a driving current for image display based on the direct current signal.

At least one embodiment of the present disclosure further provides a display device, the display device comprises a display panel and the level converter according to any one of the embodiments of the present disclosure, and the level converter is connected to the display panel to provide the direct current signal to the display panel.

For example, the display device provided by an embodiment of the present disclosure further comprises a processor, and the processor is connected to the level converter and is used for obtaining the image data of the image to be displayed and sending the image data, which is obtained, of the image to be displayed to the level converter.

For example, in the display device provided by an embodiment of the present disclosure, the display panel comprises a plurality of sub-pixels arranged in an array, and at least one of the plurality of sub-pixels comprises a micro light-emitting diode.

For example, in the display device provided by an embodiment of the present disclosure, the level converter is used for providing the display panel with the direct current signal for achieving display of a low gray scale lower than a middle value of a range of display gray scale values.

At least one embodiment of the present disclosure further provides a data processing method, and the data processing method is applied to the level converter according to any one of the embodiments of the present disclosure. The data processing method comprises: storing the image data of the image to be displayed; obtaining the control data corresponding to the image data of the image to be displayed according to the image data; and controlling whether each of the plurality of level conversion circuits performs level conversion according to the control data.

For example, in the data processing method provided by an embodiment of the present disclosure, obtaining the control data corresponding to the image data of the image to be displayed according to the image data, comprises: obtaining a magnitude of a current required to display the image data of the image to be displayed according to the image data; and obtaining the control data corresponding to the current according to a preset correspondence between a display current and control data.

For example, the data processing method provided by an embodiment of the present disclosure further comprises obtaining the image data of the image to be displayed.

For example, in the data processing method provided by an embodiment of the present disclosure, the image data of the image to be displayed comprises image data used for achieving display of a low gray scale lower than a middle value of a range of display gray scale values.

BRIEF DESCRIPTION OF THE DRAWINGS

In order to clearly illustrate the technical solutions of the embodiments of the present disclosure, the drawings of the embodiments will be briefly described in the following. It is obvious that the described drawings are only related to some embodiments of the present disclosure and thus are not limitative to the present disclosure.

DETAILED DESCRIPTION

Figure 1:
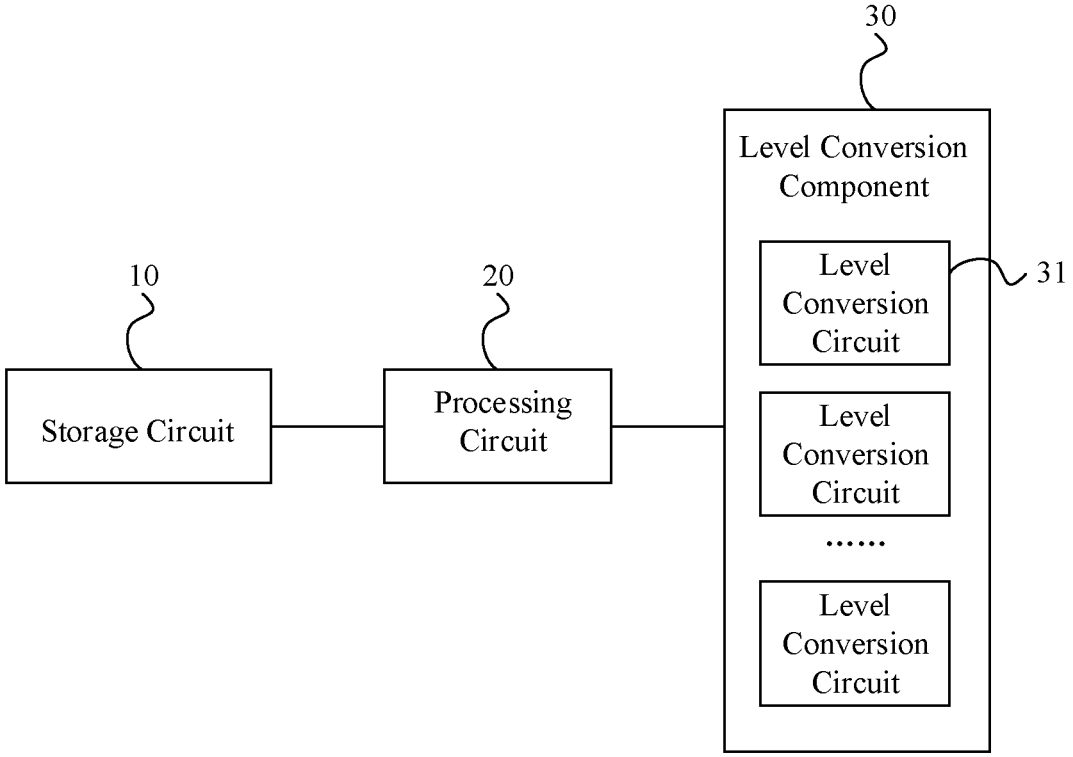
FIG. 1 is a schematic structural diagram of a level converter provided by some embodiments of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect," "connected," "coupled," etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

At present, the micro light-emitting diode (micro LED) display product includes a micro light-emitting diode, a pixel circuit, and a level converter. The pixel circuit is used to provide a driving current for the micro light-emitting diode to drive the micro light-emitting diode to emit light, the level converter is used to provide a direct current voltage to the pixel circuit to allow the pixel circuit to generate the driving current, and therefore, the driving current provided by the pixel circuit is related to the direct current voltage provided by the level converter. The inventor researched and found that at present, the conversion efficiency of the level converter is low, which makes the output stability of the level converter low and further causes the driving current provided by the pixel circuit to fluctuate accordingly in a frame of image. Because the display effect of the micro light-emitting diode may be easily affected by change of the current, the display effect of the micro light-emitting diode may correspondingly fluctuate, which reduces the display effect and reliability of the micro light-emitting diode display product.

At least one embodiment of the present disclosure provides a level converter, and the level converter is used for providing a direct current signal for image display and includes a storage circuit, a processing circuit, and a level conversion component. The level conversion component includes a plurality of level conversion circuits; the storage circuit is configured to store image data of an image to be displayed; the processing circuit is in signal connection with the storage circuit, and is configured to obtain control data corresponding to the image data of the image to be displayed according to the image data; and the level conversion component is in signal connection with the processing circuit, and is configured to control whether each of the plurality of level conversion circuits performs level conversion according to the control data, so as to generate the direct current signal.

The level converter provided by the embodiments of the present disclosure respectively controls the plurality of level conversion circuits in the level conversion component through the control data obtained based on the image data, which improves the conversion efficiency of the level converter and improves the output stability of the level converter. Furthermore, in the case where the level converter is used to provide the direct current signal for image display, the display effect of the image can be improved, and the quality and stability of the display image can be improved.

For example, in the case where the level converter is applied to a display panel including a micro light-emitting diode, the level conversion capability of the level converter may be adjusted according to the magnitudes of different driving currents required for the image to be displayed, so as to improve the conversion efficiency of the level converter in the case of such as low gray scale display, so that the level converter may also provide a stable output effect in the case where the level converter is used for low gray scale display. In addition, the stability of the micro light-emitting diode in the case of such as the low gray scale display may be further improved, so that the stability and reliability of the display panel including the micro light-emitting diode may be improved, and the display effect of the image may be improved.

FIG. 1 is a schematic structural diagram of a level converter provided by some embodiments of the present disclosure. As illustrated in FIG. 1, the level converter provided by some embodiments of the present disclosure includes a storage circuit 10, a processing circuit 20, and a level conversion component 30. The level conversion component 30 includes a plurality of level conversion circuits 31, and for example, the level conversion component 30 may include N level conversion circuits 31, where N is an integer greater than or equal to 2, that is, $N \geq 2$. The embodiments of the present disclosure do not limit the number of level conversion circuits 31 in the level conversion component 30. For example, the level conversion component 30 may include 2, 3, 4 or more level conversion circuits 31.

Specifically, the storage circuit 10 is configured to store image data of an image to be displayed. The processing circuit 20 is connected to the storage circuit 10, and for example, the connection may be an electrical connection or a signal connection, or may also adopt other suitable connection manners. The processing circuit 20 is configured to obtain control data corresponding to the image data of the image to be displayed according to the image data. The level conversion component 30 is connected to the processing circuit 20, and for example, the connection may be an electrical connection or a signal connection, or may also adopt other suitable connection manners. The level conversion component 30 is configured to control whether each level conversion circuit 31 of the plurality of level conversion circuits 31 performs level conversion according to the control data, so as to generate a corresponding direct current signal.

For example, according to different images to be displayed, such as different gray scales corresponding to image data of the images to be displayed, the processing circuit 20 obtains different control data, and the level conversion component 30 determines the level conversion circuit(s) 31 that needs to be turned on among the plurality of the level conversion circuits 31 according to the corresponding control data. For example, the level conversion component 30 determines which level conversion circuit 31 or which level conversion circuits 31 need to be turned on, and determines the number of level conversion circuits 31 which need to be turned on, and the like according to the level conversion capability of each level conversion circuit 31, so that the level converter may achieve the conversion capability that matches the image to be displayed, thereby improving the conversion efficiency of the level converter, improving the output stability of the level converter, and reducing the required power consumption.

In some embodiments of the present disclosure, the level conversion capabilities of the plurality of level conversion circuits 31 may be the same or different, which is not limited in the embodiments of the present disclosure. For example, the level conversion capabilities of the plurality of level conversion circuits 31 may be the same, thereby reducing the manufacturing cost and simplifying the manufacturing process. For another example, the level conversion capabilities of the plurality of level conversion circuits 31 may also be different from each other, so that the plurality of level conversion circuits 31 may adopt different coordination methods according to actual requirements, thereby improving the flexibility and controllability of the level converter, and further optimizing the working modes of the plurality of level conversion circuits 31.

In some embodiments of the present disclosure, the level converter may be used to provide a direct current signal to the display panel, so that the display panel generates a driving current for display based on the direct current signal, thereby improving the display effect of the image and improving the quality and stability of the display image.

It should be noted that in some embodiments of the present disclosure, the aforementioned direct current signal may be a direct current voltage signal or a direct current level signal, such as a direct current high voltage signal (or a direct current high level signal), a direct current low voltage signal (or a direct current low level signal), or the like.

For example, the direct current signal may be used for image display. For example, the direct current signal may be a data signal for image display or a power supply signal for image display, or may also be other suitable electrical signals for image display, and the embodiments of the present disclosure are not limited in this aspect.

For example, the display panel may include a plurality of sub-pixels arranged in an array, and at least one of the plurality of sub-pixels includes a micro light-emitting diode. For example, each of the plurality of sub-pixels may include a micro light-emitting diode, so as to form a micro light-emitting diode display panel. For example, in the case where the level converter is applied to a display panel including the micro light-emitting diode, the direct current signal may be a direct current high voltage signal or a direct current low voltage signal applied to a terminal of the micro light-emitting diode. Alternatively, according to the circuit structure of the pixel circuit actually applied in the sub-pixel, the direct current signal may also be a direct current power supply voltage signal provided to the pixel circuit or a direct current data voltage signal provided to the pixel circuit, or may also be other suitable direct current signals required by the pixel circuit, so that the pixel circuit in the sub-pixel may generate the driving current for driving the micro light-emitting diode to emit light. The embodiments of the present disclosure do not limit the specific type or the like of the direct current signal.

For example, in the case where the level converter is applied to the display panel including the micro light-emitting diode, the level conversion capability of the level converter may be adjusted according to different driving currents required for the image to be displayed, thereby improving the conversion efficiency of the level converter in the case of such as low gray scale display, so that the level converter may also provide the stable output effect in the case where the level converter is used for achieving the low gray scale display. In addition, the stability of the micro light-emitting diode in the case of such as the low gray scale display may be further improved, so that the stability and reliability of the display panel including the micro light-emitting diode may be improved, and the display effect of the image may be improved.

In some embodiments of the present disclosure, the data stored in the storage circuit 10 is generated by a processor connected to the display panel. For example, the connection may be a signal connection, an electrical connection, or other suitable connection manners. The data is transmitted to the level converter through a data interface. For example, the data interface may include a mobile industry processor interface (MIPI) or a low-voltage differential signaling (LVDS), or the data interface may also be other interfaces, which is not limited in the embodiments of the present disclosure.

In some embodiments of the present disclosure, the size of data buffered in a memory space of the storage circuit 10 is greater than the size of data of one image frame, so as to store the image data of at least one image frame of the image to be displayed, thereby facilitating improving the display effect of each frame of image and further improving the user experience. Alternatively, in some other embodiments of the present disclosure, the storage circuit 10 may also be used to store part of the image data corresponding to one image frame, that is, the size of data buffered in the memory space of the storage circuit 10 may also be less than or equal to the size of data of one image frame. The storage circuit 10 may obtain the image data of one image frame by performing summation calculation on the stored image data corresponding to multiple parts of one image frame, thereby reducing the required storage space and optimizing the structure of the storage circuit 10.

In some embodiments of the present disclosure, the image data refers to the luminous brightness of each pixel of the image to be displayed, for example, the gray scale corresponding to each pixel.

In some embodiments of the present disclosure, the control data may be transmitted to the level conversion component through an inter-integrated circuit (I2C) bus interface, or may also be transmitted through other suitable data transmission methods, such as wireless transmission or the like, and the embodiments of the present disclosure are not limited in this aspect.

The level converter provided by the embodiments of the present disclosure is used to provide a direct current signal to a display panel. The display panel includes, for example, a micro light-emitting diode, and the level converter includes a storage circuit, a processing circuit, and a level conversion component. The level conversion component includes N level conversion circuits, for example, N is an integer greater than or equal to 2, i.e., $N \geq 2$. The storage circuit is configured to store image data of an image to be displayed. The processing circuit is connected to the storage circuit and is configured to obtain control data corresponding to the image data of the image to be displayed according to the image data. The level conversion component is connected to the processing circuit and is configured to control whether each level conversion circuit performs level conversion according to the control data. The level converter provided by the embodiments of the present disclosure controls the level conversion circuits in the level conversion component by obtaining the control data according to the image data, thereby improving the conversion efficiency of the level converter, improving the output stability of the level converter, and further improving the display effect and reliability of the display product including the micro light-emitting diode (micro LED).

In some embodiments of the present disclosure, the storage circuit 10 may include a memory, such as a random access memory, or may also include other devices capable of implementing a storage function, and the embodiments of the present disclosure are not limited in this aspect.

In some embodiments of the present disclosure, the random access memory may be used as a temporary data storage medium, so that data can be read and written in real time, thereby improving the read and write speed of data and further improving the processing efficiency.

For example, the memory may include an arbitrary combination of one or more computer program products. The computer program products may include various forms of computer readable storage media, such as the volatile memory and/or non-volatile memory. The volatile memory may include, for example, a random access memory (RAM) and/or a cache or the like. The non-volatile memory may include, for example, a read-only memory (ROM), a hard disk, an erasable programmable read-only memory (EPROM), a portable compact disc read-only memory (CD-ROM), a USB memory, a flash memory, etc.

In some embodiments of the present disclosure, the level conversion circuit includes a boost circuit and/or a buck circuit. For example, the boost circuit and the buck circuit may refer to circuit structures known in the art, and details are not described in the embodiments of the present disclosure. For example, the boost circuit may achieve the voltage (or level) rising conversion, and the buck circuit may achieve the voltage (or level) decreasing conversion.

In some embodiments of the present disclosure, the processing circuit 20 is specifically configured to obtain the magnitude of the current required to display the image data of the image to be displayed according to the image data, and obtain the control data corresponding to the current according to the pre-stored corresponding relationship between the current (for example, the display current) and the control data, that is, the preset correspondence between the current and the control data. Therefore, the level converter may obtain corresponding control data according to different actual currents required for image display, that is, the actual currents required for providing the image data, thereby achieving different level conversion capabilities based on the control data.

It should be noted that the greater the current required to display the image data, the higher the level conversion capability that the level converter needs to achieve, for example, the more level conversion circuits performing level conversion. In the case where the current required to display the image data is small, the level conversion capability that the level converter needs to achieve may be relatively lower, for example, fewer level conversion circuits need to perform level conversion.

In the embodiments of the present disclosure, whether the plurality of level conversion circuits perform level conversion may be separately controlled according to the control data corresponding to the current, so that the level conversion capability of the level converter is dynamically matched with the required current, and the conversion rate of the level converter is relatively high, thereby achieving the stable output of the level converter and ensuring the normal display and uniform color display of the display component adopting the level converter, such as a micro light-emitting diode (micro LED) to which the level converter is applied.

In some embodiments of the present disclosure, the processing circuit 20 includes a field programmable gate array, or may also include other devices or components which may implement the same or similar function, and the embodiments of the present disclosure are not limited in this aspect.

In some embodiments of the present disclosure, the control data refers to a set consisting of data "1" and data "0."

For example, the number of bits of data included in the control data may be the same as the number of level conversion circuits, that is, if there are four level conversion circuits, the control data is a four-digit number. Alternatively, the number of bits of data included in the control data may also be less than the number of level conversion circuits. For example, according to actual needs, two or three level conversion circuits may be set to receive the same bit of the control data. For example, if there are four level conversion circuits, the control data may also be set to a three-digit number.

Figure 2:
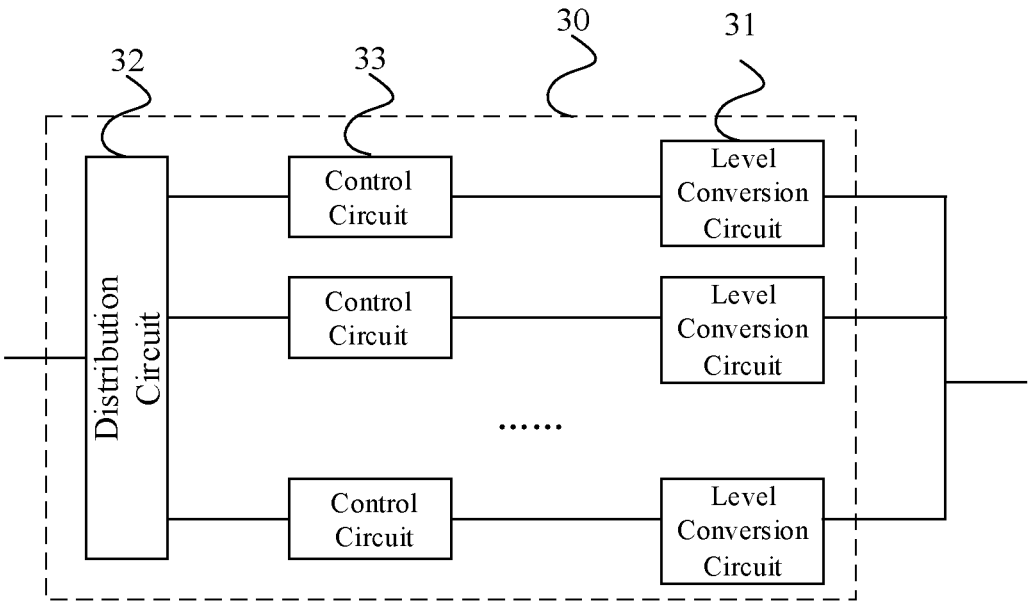
FIG. 2 is a schematic structural diagram of a level conversion component provided by some embodiments of the present disclosure.

FIG. 2 is a schematic structural diagram of a level conversion component provided by some embodiments of the present disclosure. As illustrated in FIG. 2, the level conversion component 30 in the level converter provided by the embodiments of the present disclosure further includes a distribution circuit 32 and a plurality of control circuits 33, for example, N control circuits 33, where N is a positive integer greater than or equal to 2.

In some embodiments of the present disclosure, each control circuit 33 corresponds to at least one level conversion circuit 31.

In some examples, for example, as illustrated in FIG. 2, each control circuit 33 may correspond to one level conversion circuit 31, that is, the plurality of level conversion circuits 31 are in one-to-one correspondence with the plurality of control circuits 33.

The following embodiments of the present disclosure are described by taking the plurality of level conversion circuits 31 being in one-to-one correspondence with the plurality of control circuits 33 as an example, which is not limitative to the present disclosure.

Specifically, the distribution circuit 32 is connected to the processing circuit (not shown in FIG. 2) and the plurality of control circuits 33 (for example, N control circuits 33), respectively, and the distribution circuit 32 is configured to respectively provide a plurality of data units, which are in one-to-one correspondence with the plurality of control circuits, to the plurality of control circuits based on the control data, so as to control the working states of the plurality of control circuits, respectively. For example, the distribution circuit 32 may generate the plurality of data units based on the control data and provide the plurality of data units to the plurality of control circuits, respectively, and each control circuit is turned on or turned off under the control of the corresponding data unit.

In some embodiments of the present disclosure, the distribution circuit 32 determines the control circuit 33 that needs to be turned on and the control circuit 33 that needs to be turned off among the plurality of control circuits 33 based on the control data, thereby controlling whether the level conversion circuit 31 connected to each control circuit 33 performs level conversion, so as to control the level conversion capability of the level converter.

For example, in some examples, the distribution circuit 32 is configured to divide the control data into the plurality of data units (for example, N data units) which are in one-to-one correspondence with the plurality of control circuits 33, and distribute each data unit to the corresponding control circuit. Each control circuit 33 is connected to the corresponding level conversion circuit 31, and is configured to control whether the corresponding level conversion circuit 31 performs level conversion according to the data unit. For example, dividing the control data may refer to generating data units for controlling the working states of the plurality of control circuits based on the control data. The embodiments of the present disclosure do not limit the specific method of dividing the control data.

Specifically, the embodiments of the present disclosure may control the actual loading capability of the signal by controlling whether each level conversion circuit 31 performs level conversion, thereby optimizing the conversion efficiency of the level converter and improving the output stability of the level converter.

For example, the distribution circuit 32 generates the plurality of data units based on the control data, for example, divides the control data into the plurality of data units (for example, N data units). Specifically, the control data is sequentially divided to obtain N data units, so that the N data units are in one-to-one correspondence with the N control circuits 33, respectively.

For example, the data unit includes the first data or second data, and the first data and the second data are different data. For example, the first data is "0," and the second data is "1." Alternatively, the first data is "1," and the second data is "0," and the embodiments of the present disclosure are not limited in this aspect.

In some embodiments of the present disclosure, the distribution circuit includes a data distributor, or the distribution circuit may also be other devices or components capable of achieving data distribution, which is not limited in the embodiments of the present disclosure.

Figure 3:
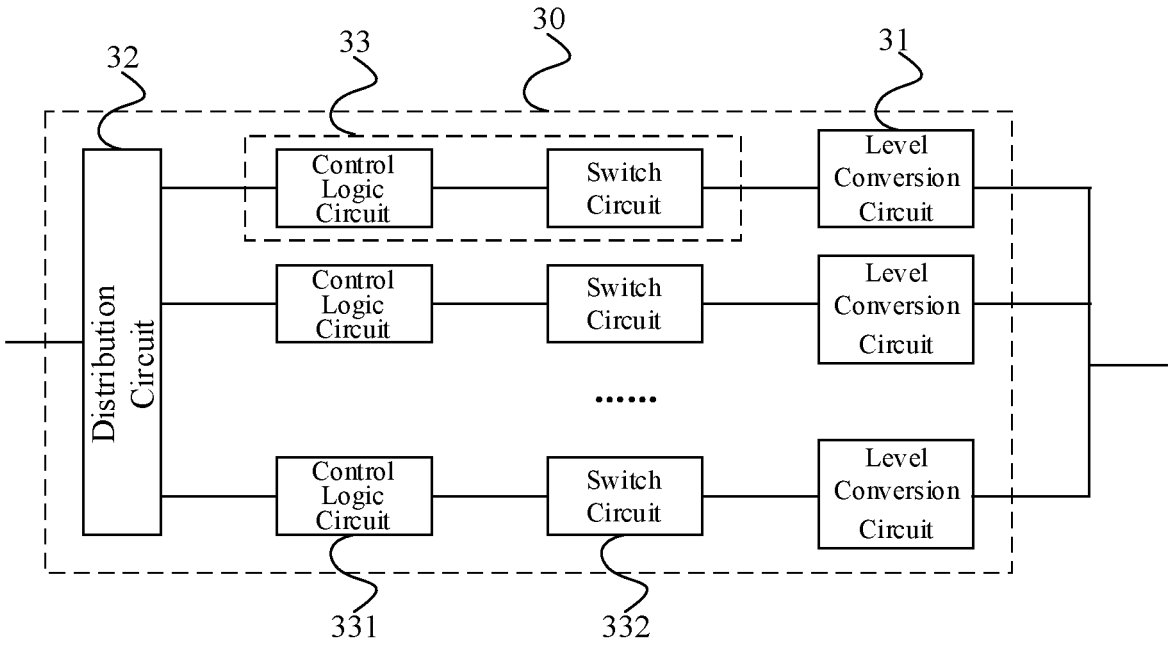
FIG. 3 is a schematic structural diagram of another level conversion component provided by some embodiments of the present disclosure.

For example, FIG. 3 is a schematic structural diagram of a level conversion component provided by some embodiments of the present disclosure.

For example, each control circuit 33 includes a control logic circuit 331 and a switch circuit 332.

For example, the control logic circuit 331 is connected to the distribution circuit 32 and the switch circuit 332, respectively, and the level conversion circuit 31 is connected to the switch circuit 332. The control logic circuit 331 is configured to control the switch circuit 332 to be turned on or turned off according to the corresponding data unit provided by the distribution circuit 32, thereby controlling whether the level conversion circuit 31 connected to the switch circuit 332 performs level conversion.

For example, the control logic circuit 331 is configured to control the switch circuit 332 to be turned on in the case where the data unit provided by the distribution circuit 32 is the first data, so that the level conversion circuit 31 performs level conversion; and the control logic circuit 331 is configured to control the switch circuit 332 to be turned off in the case where the data unit provided by the distribution circuit 32 is the second data, so that the level conversion circuit 31 does not perform level conversion.

It should be noted that the level converter in the related art is only a level conversion circuit, and the interior of the level converter in the related art is not divided. Because the conversion efficiency of the level converter is low, the current of the micro light-emitting diode (micro LED), to which the level converter is applied, is unstable in a low gray scale state, which leads to a poor display effect. And the level converter provided by the embodiments of the present disclosure may effectively improve the conversion efficiency of the level converter, and may also improve the stability of the current flowing through such as the micro LED to which the level converter is applied, thereby ensuring normal display and uniform color display of the micro LED.

It should be noted that the micro light-emitting diode (micro LED) mentioned in the embodiments of the present disclosure may refer to a light-emitting diode with a size not greater than 100 micrometers. For example, the size of the micro light-emitting diode may range from 1 micrometer to 80 micrometers, and further, for example, from 20 micrometers to 50 micrometers.

For example, in the embodiments of the present disclosure, the "low gray scale" may refer to 50% (that is, lower than the middle value) starting from the minimum value of the entire value range (for example, 0 to 255) of the display gray scale corresponding to the image data. For another example, the "low gray scale" may refer to 30% starting from the minimum value of the entire value range, such as 0 to 77, or may further refer to 25% starting from the minimum value of the entire value range, such as 0 to 64, or the "low gray scale" may also refer to other suitable low value ranges, and the embodiments of the present disclosure are not limited in this aspect.

Figure 4A:
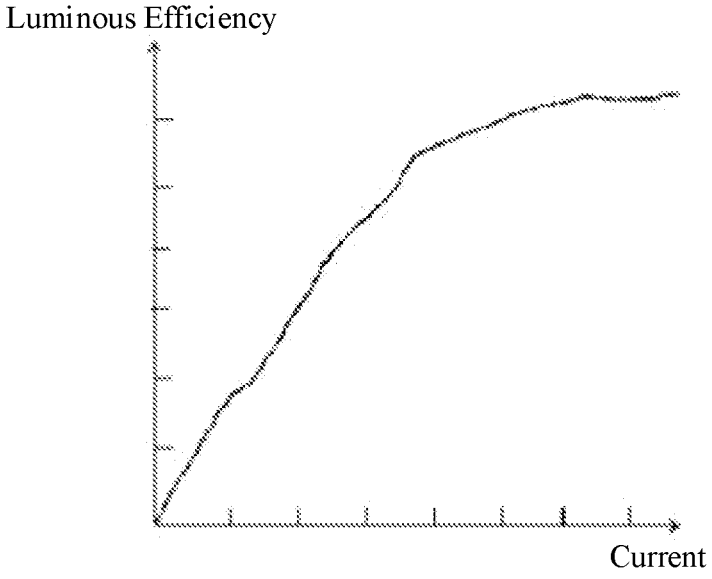
FIG. 4A is a schematic diagram of a correspondence between a current and luminous efficiency of a display panel adopting a level converter in the related art.
Figure 4B:
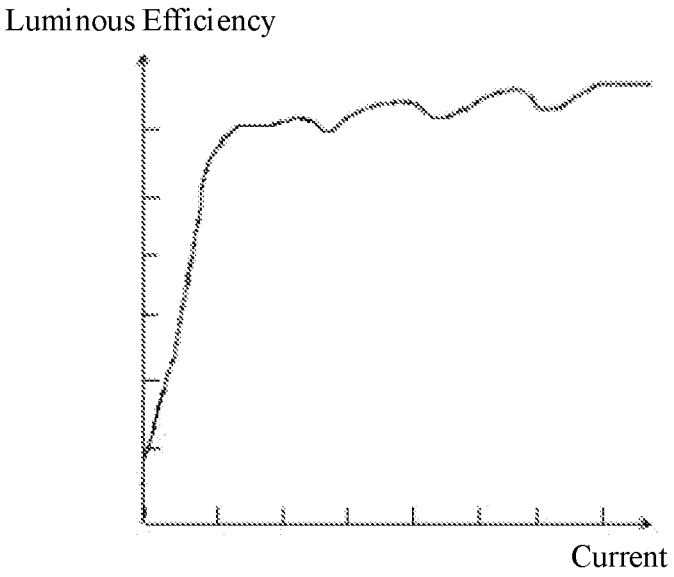
FIG. 4B is a schematic diagram of a correspondence between a current and luminous efficiency of a display panel adopting a level converter provided by some embodiments of the present disclosure.

In this embodiment, taking the micro LED displaying in a low gray scale state as an example, FIG. 4A is a schematic diagram of a correspondence between a current and luminous efficiency of a display panel adopting a level converter in the related art, and FIG. 4B is a schematic diagram of a correspondence between a current and luminous efficiency of a display panel adopting a level converter provided by some embodiments of the present disclosure.

For example, the luminous efficiency of the micro LED represents the display effect of the micro LED. As illustrated in FIG. 4A and FIG. 4B, when the micro LED is in the state of low gray scale display, the display effect of the display panel using the level converter provided by the embodiments of the present disclosure is relatively stable, and the display effect of the micro LED is not sensitive to the change of the current, thereby improving the stability of the micro LED in the case of such as the low gray scale display and further improving the stability and reliability of the display panel including the micro LED, so as to improve the display effect of the image.

A data processing method is further provided by some embodiments of the present disclosure, and the data processing method may be applied to the level converter provided by the foregoing embodiments.

Figure 5:
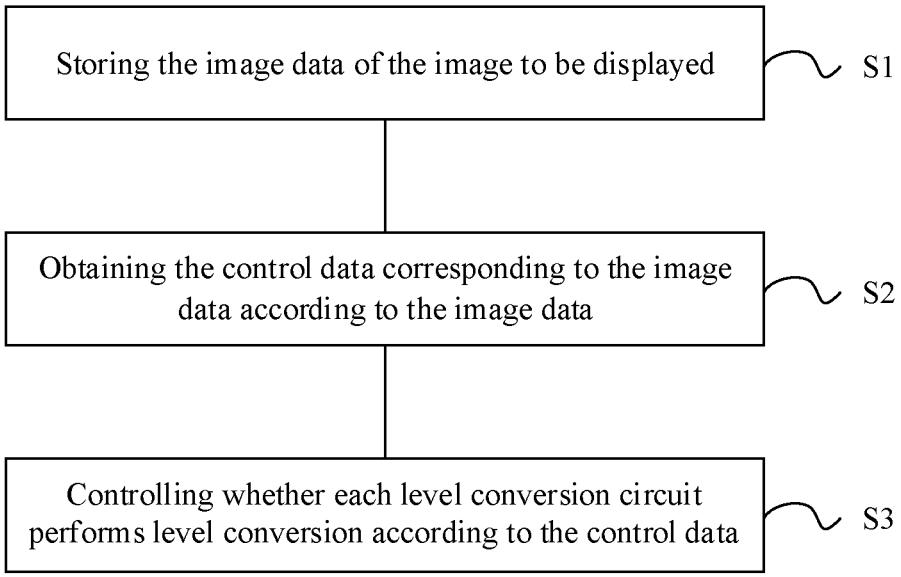
FIG. 5 is a flowchart of a data processing method provided by some embodiments of the present disclosure.

FIG. 5 is a flowchart of a data processing method provided by some embodiments of the present disclosure. As illustrated in FIG. 5, the data processing method provided by the embodiments of the present disclosure may include the following steps.

Step S1: storing the image data of the image to be displayed.

Specifically, the execution subject of step S1 may be the storage circuit, such as the storage circuit 10 illustrated in FIG. 1.

Step S2: obtaining the control data corresponding to the image data according to the image data.

Specifically, the execution subject of step S2 may be the processing circuit, such as the processing circuit 20 illustrated in FIG. 1.

Step S3: controlling whether each level conversion circuit performs level conversion according to the control data.

Specifically, the execution subject of step S3 may be the level conversion component, such as the level conversion component 30 illustrated in FIG. 1.

The data processing method provided by some embodiments of the present disclosure can be applied to the level converter provided by the foregoing embodiments, the implementation principle and effect of the data processing method are similar to those of the level converter, and details are not described herein.

In some embodiments of the present disclosure, step S2 may include: obtaining a magnitude of a current required to display the image data of the image to be displayed according to the image data, and obtaining the control data corresponding to the current according to a preset correspondence between a display current and control data, for example, according to the magnitude of the current and the preset correspondence between the magnitude of the current and the control data.

In some embodiments of the present disclosure, step S3 may include: providing a plurality of data units, which are in one-to-one correspondence with the plurality of control circuits, to the plurality of control circuits based on the control data, so as to control the working states of the plurality of control circuits, respectively.

For example, in some examples, step S3 may include: dividing the control data into the plurality of data units, such as N data units, where N is an integer greater than or equal to 2, distributing each data unit to a corresponding control circuit, and controlling whether the corresponding level conversion circuit performs level conversion according to the data unit.

In some embodiments of the present disclosure, the data processing method provided by the embodiments of the present disclosure may further include: obtaining the image data of the image to be displayed, so as to be used for the foregoing steps S1 to S3.

In some embodiments of the present disclosure, the image data of the image to be displayed includes image data used to achieve display of a low gray scale lower than a middle value of a range of display gray scale values. Therefore, when using the data processing method provided by the embodiments of the present disclosure to implement image display, the stability of the display image in the low gray scale state can be improved, and the display effect of the image can be improved.

A display device is further provided by some embodiments of the present disclosure.

Figure 6:
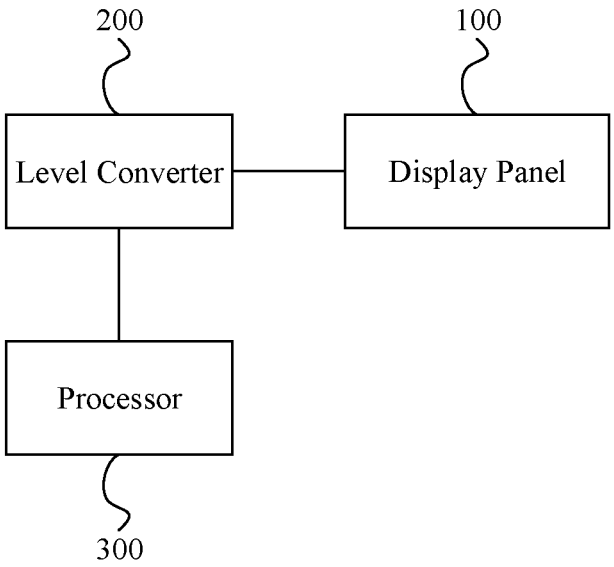
FIG. 6 is a schematic structural diagram of a display device provided by some embodiments of the present disclosure.

FIG. 6 is a schematic structural diagram of a display device provided by some embodiments of the present disclosure. As illustrated in FIG. 6, the display device provided by the embodiments of the present disclosure includes a display panel 100 and a level converter 200. For example, the level converter 200 may be a level converter provided by any one of the embodiments of the present disclosure, and for example, may be the level converter as illustrated in FIG. 1.

For example, the level converter 200 is connected to the display panel 100 to provide a direct current signal to the display panel 100. For example, the connection may be a signal connection, an electrical connection, or other suitable connection manners, and the embodiments of the present disclosure are not limited in this aspect.

In some embodiments of the present disclosure, as illustrated in FIG. 6, the display device further includes a processor 300.

The processor 300 is connected to the level converter 200, and is used to obtain the image data of the image to be displayed and send the obtained image data of the image to be displayed to the level converter 200.

In some embodiments of the present disclosure, the display panel 100 may include a plurality of sub-pixels arranged in an array, and at least one of the plurality of sub-pixels includes a micro light-emitting diode (micro LED). For example, each of the plurality of sub-pixels may include a micro light-emitting diode, so as to form a micro light-emitting diode display panel.

In some embodiments of the present disclosure, the level converter 200 is used to provide the display panel 100 with a direct current signal used for achieving display of a low gray scale lower than a middle value of a range of display gray scale values, thereby improving the stability of the display image provided by the display panel 100 in the low gray scale state and improving the display effect of the image.

Specifically, the level converter 200 includes an input terminal and an output terminal. The output terminal of the level converter 200 is connected to the display panel 100, and the input terminal of the level converter 200 is connected to the processor 300.

For example, the processor 300 may be located in the display panel 100, or may be provided independently of the display panel 100 and be connected to an interface connector of the display device to obtain the image data of the image to be displayed.

For example, the processor 300 may be a central processing unit (CPU), a digital signal processor (DSP), or other forms of processing units having data processing capabilities and/or program execution capabilities, such as a field programmable gate array (FPGA) or the like. For example, the central processing unit (CPU) may be an X86, an ARM architecture, or the like. The processor 300 may be a general-purpose processor or a dedicated processor, and may control other components in the display device to perform desired functions.

It should be noted that the display device provided by the embodiments of the present disclosure may further include other components, and these components may, for example, adopt existing conventional components, which are not described in detail here.

For example, the display device provided by the embodiments of the present disclosure may be any product or component with a display function, such as a display substrate, a display panel, an electronic paper, a mobile phone, a tablet computer, a television, a display, a notebook computer, a digital photo frame, a navigator, etc., and the embodiments of the present disclosure are not limited in this aspect.

Those skilled in the art can understand that all or some of the steps in the methods disclosed above and the functional modules or units in systems and devices can be implemented by software, firmware, hardware, and other appropriate combinations thereof. In the hardware implementation, the division between functional modules or units mentioned in the above description does not necessarily correspond to the division of physical components. For example, one physical component may have a plurality of functions, or one function or step may be executed by several physical components in cooperation. Some or all of the components may be implemented as software executed by a processor, such as a digital signal processor or a microprocessor, or may be implemented as hardware or as an integrated circuit, such as an application specific integrated circuit. Such software may be distributed on a computer-readable medium, and the computer-readable medium may include a computer storage medium (or a non-volatile medium) and a communication medium (or a volatile medium). As well known to those skilled in the art, the term computer storage medium includes volatile and nonvolatile media and removable and non-removable media implemented in any method or technology for storing information (such as computer-readable instructions, data structures, program modules, or other data). Computer storage media include but are not limited to the RAM, ROM, EEPROM, flash memory or other storage technologies, CD-ROM, digital versatile disk (DVD) or other optical disk storage, magnetic cassettes, magnetic tapes, magnetic disk storage or other magnetic storage devices, or any other medium that can be used to store desired information and can be accessed by a computer. In addition, as well known to those skilled in the art, communication media usually include computer-readable instructions, data structures, program modules, or other data in a modulated data signal such as carrier waves or other transmission mechanisms, and may include any information delivery medium.

The following statements should be noted:

(1) The accompanying drawings of the embodiments of the present disclosure involve only the structure(s) in connection with the embodiment(s) of the present disclosure, and other structure(s) can be referred to common design(s).

(2) For the purpose of clarity, in the accompanying drawings for illustrating the embodiment(s) of the present disclosure, the thickness of a layer or a region may be enlarged or narrowed, that is, the drawings are not drawn in a real scale. It should be understood that, in the case where a component such as a layer, a film, a region, a substrate, or the like is referred to be "on" or "under" another component, the component may be "directly" "on" or "under" the another component, or an intermediate component may be disposed therebetween.

(3) In case of no conflict, the embodiments of the present disclosure and features in one embodiment or in different embodiments can be combined to obtain new embodiments.

What have been described above merely are specific implementations of the present disclosure, and the protection scope of the present disclosure is not limited thereto. Any modifications or substitutions that easily occur to those skilled in the art within the technical scope of the present disclosure should be within the protection scope of the present disclosure. Therefore, the protection scope of the present disclosure should be based on the protection scope of the claims.

What is claimed is:

1. A level converter, used for providing a direct current signal for image display, comprising a storage circuit, a processing circuit, and a level conversion component, wherein the level conversion component comprises a plurality of level conversion circuits;

the storage circuit is configured to store image data of an image to be displayed;

the processing circuit is in signal connection with the storage circuit, and is configured to obtain control data corresponding to the image data of the image to be displayed according to the image data; and the level conversion component is in signal connection with the processing circuit, and is configured to control whether each of the plurality of level conversion circuits performs level conversion according to the control data, so as to generate the direct current signal.

2. The level converter according to claim 1, wherein the processing circuit is configured to obtain a magnitude of a current required to display the image data of the image to be displayed according to the image data, and obtain the control data corresponding to the current according to a preset correspondence between a display current and control data.

3. The level converter according to claim 1, wherein the level conversion component further comprises a distribution circuit and a plurality of control circuits, and each of the plurality of control circuits corresponds to at least one level conversion circuit;

the distribution circuit is connected to the processing circuit and the plurality of control circuits, respectively, and is configured to respectively provide a plurality of data units, in one-to-one correspondence with the plurality of control circuits, to the plurality of control circuits based on the control data, so as to control working states of the plurality of control circuits, respectively; and the each of the plurality of control circuits is connected to at least one corresponding level conversion circuit and is configured to control whether the corresponding level conversion circuit performs level conversion according to a corresponding data unit.

4. The level converter according to claim 3, wherein the distribution circuit is configured to divide the control data into the plurality of data units and distribute each of the plurality of data units to a corresponding control circuit.

5. The level converter according to claim 3, wherein the plurality of control circuits are in one-to-one correspondence with the plurality of level conversion circuits.

6. The level converter according to claim 3, wherein the each of the plurality of control circuits comprises a control logic circuit and a switch circuit, the control logic circuit is connected to the distribution circuit and the switch circuit, the level conversion circuit is connected to the switch circuit, and the control logic circuit is configured to control the switch circuit to be turned on or turned off according to the corresponding data unit, so as to control whether the level conversion circuit connected to the switch circuit performs level conversion.

7. The level converter according to claim 6, wherein each of the plurality of data units comprises first data or second data, the first data being different from the second data; and the control logic circuit is configured to control the switch circuit to be turned on to allow the level conversion circuit to perform level conversion in a case where the corresponding data unit is the first data, and the control logic circuit is configured to control the switch circuit to be turned off to allow the level conversion circuit to be unable to perform level conversion in a case where the corresponding data unit is the second data.

8. The level converter according to claim 3, wherein the storage circuit comprises a random access memory, the processing circuit comprises a field programmable gate array, and the distribution circuit comprises a data distributor.

9. The level converter according to claim 1, wherein a size of data buffered in a memory space of the storage circuit is greater than a size of data for one image frame.

10. The level converter according to claim 1, wherein the each of the plurality of level conversion circuits comprises a boost circuit and/or a buck circuit.

11. The level converter according to claim 1, wherein the level converter is used for providing the direct current signal to a display panel, so as to enable the display panel to generate a driving current for image display based on the direct current signal.

12. A display device, comprising a display panel and the level converter according to claim 1, wherein the level converter is connected to the display panel to provide the direct current signal to the display panel.

13. The display device according to claim 12, further comprising a processor, wherein the processor is connected to the level converter and is used for obtaining the image data of the image to be displayed and sending the image data, which is obtained, of the image to be displayed to the level converter.

14. The display device according to claim 12, wherein the display panel comprises a plurality of sub-pixels arranged in an array, and at least one of the plurality of sub-pixels comprises a micro light-emitting diode.

15. The display device according to claim 12, wherein the level converter is used for providing the display panel with the direct current signal for achieving display of a low gray scale lower than a middle value of a range of display gray scale values.

16. A data processing method, applied to a level converter used for providing a direct current signal for image display, wherein the level converter comprises a storage circuit, a processing circuit, and a level conversion component, the level conversion component comprises a plurality of level conversion circuits, the storage circuit is configured to store image data of an image to be displayed, the processing circuit is in signal connection with the storage circuit and is configured to obtain control data corresponding to the image data of the image to be displayed according to the image data, and the level conversion component is in signal connection with the processing circuit and is configured to control whether each of the plurality of level conversion circuits performs level conversion according to the control data, so as to generate the direct current signal; and the data processing method comprises:

storing the image data of the image to be displayed;

obtaining the control data corresponding to the image data of the image to be displayed according to the image data; and controlling whether each of the plurality of level conversion circuits performs level conversion according to the control data.

17. The method according to claim 16, wherein obtaining the control data corresponding to the image data of the image to be displayed according to the image data, comprises:

obtaining a magnitude of a current required to display the image data of the image to be displayed according to the image data; and obtaining the control data corresponding to the current according to a preset correspondence between a display current and control data.

18. The method according to claim 16, further comprising:

obtaining the image data of the image to be displayed.

19. The method according to claim 16, wherein the image data of the image to be displayed comprises image data used for achieving display of a low gray scale lower than a middle value of a range of display gray scale values.

* * * * *